US007962055B2

(12) United States Patent
Takuma et al.

(10) Patent No.: US 7,962,055 B2
(45) Date of Patent: Jun. 14, 2011

(54) IMAGE FORMING APPARATUS

(75) Inventors: Yasuo Takuma, Ibaraki (JP); Masanari Fujita, Ibaraki (JP); Masaki Tsuchiya, Ibaraki (JP); Nobuaki Fukasawa, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 680 days.

(21) Appl. No.: 11/785,573

(22) Filed: Apr. 18, 2007

(65) Prior Publication Data

US 2007/0286633 A1 Dec. 13, 2007

(30) Foreign Application Priority Data

Apr. 19, 2006 (JP) ..... P2006-115641
Feb. 21, 2007 (JP) ..... P2007-040407

(51) Int. Cl.
*G03G 15/00* (2006.01)

(52) U.S. Cl. ..... 399/44; 399/66

(58) Field of Classification Search ..... 399/44, 399/50

See application file for complete search history.

(56) References Cited

U.S. PATENT DOCUMENTS 5,842,081 A * 11/1998 Kaname et al. ..... 399/50
6,744,994 B2 * 6/2004 Yoshikawa et al. ..... 399/44
6,952,546 B2 * 10/2005 Yoshikawa ..... 399/129
2003/0091368 A1 * 5/2003 Yamamoto et al. ..... 399/116
2004/0240899 A1 * 12/2004 Ebe ..... 399/44
2005/0196190 A1 * 9/2005 Yamada ..... 399/66
2006/0245774 A1 * 11/2006 Nakamura ..... 399/50

FOREIGN PATENT DOCUMENTS

| | | |
|---|---|---|
| JP | 41-21432 | 12/1966 |
| JP | 64-35459 | 2/1989 |
| JP | 64-35460 | 2/1989 |
| JP | 3-52058 | 8/1991 |
| JP | 4-21875 | 1/1992 |
| JP | 4-30186 | 2/1992 |
| JP | 6-289688 | 10/1994 |
| JP | 10-171187 | 6/1998 |
| JP | 2001-100469 | 4/2001 |
| JP | 3230019 | 9/2001 |
| JP | 2002-55499 | 2/2002 |
| JP | 2005-331846 | 12/2005 |

* cited by examiner

*Primary Examiner* — David M Gray
*Assistant Examiner* — Roy Yi
(74) *Attorney, Agent, or Firm* — McGinn IP Law, PLLC

(57) ABSTRACT

According to one embodiment, an image forming apparatus includes a photoreceptor, a charging unit, an exposure unit, a developing unit, a transfer unit, a fixing unit, an environment detecting unit and a control unit. The charging unit includes a charger and a static eliminator. The charger contacts with a surface of the photoreceptor and charges the surface to a first voltage. The static eliminator contacts with the surface and discharges the surface to a second voltage. The environment detecting unit detects an environmental data. The control unit controls the first voltage based on the environmental data.

21 Claims, 4 Drawing Sheets

IMAGE FORMING APPARATUS

CROSS-REFERENCE TO RELATED APPLICATIONS

This application is based upon and claims a priority from prior Japanese Patent Application No. 2006-115641 filed on Apr. 19, 2006 and from prior Japanese Patent Application No. 2007-040407 filed on Feb. 21, 2007, the entire contents of which are incorporated herein by reference.

BACKGROUND OF THE INVENTION

1. Field of the Invention

The present invention relates to an image forming apparatus, such as a printer or a copy machine, which uses a charging device.

2. Description of the Related Art

In an image forming apparatus, such as a printer or a copy machine, a charging device has been widely used which charges a photoreceptor that rotates in one direction with a predetermined voltage V0 by corona discharge. Corona discharge has an advantage in that it uniformly charges the photoreceptor. However, the corona discharge uses a high direct-current voltage in a range of 4 to 6 kV. Therefore, ozone generation is caused at the time of corona discharge and thus affects the environment.

JP-B-3-52058 suggests a contact-type charging device in which a brush or roller comes into contact with a photoreceptor, an alternating current voltage is applied thereon, a desired charging voltage is obtained from a relatively low voltage, and discharge to the ozone is rarely caused.

Further, each of JP-B-41-21432, JP-A-64-35459, JP-A-1-35460, JP-A-4-21875, JP-A-4-30186, Japanese Patent Number 3230019, JP-A-6-289688 and JP-A-2005-331846 discloses charging method, in which a uniform surface voltage is applied to a photoreceptor, an alternating current voltage source is not used, and a capability to remove a voltage history of the photoreceptor is excellent.

Further, JP-A-2001-100469 suggests an image forming apparatus in which high image quality can be obtained even under various environmental conditions.

A charging device that is disclosed in JP-B-3-52058 has the following advantages. In the charging device, discharge to the ozone is great reduced (the charging device discharges the ozone in a range of 1/10 to 1/100 to the ozone when using corona discharge) to realize uniform charging, and a capability to remove the voltage history of a photoreceptor is excellent. As a result, according to the charging device that is disclosed in JP-B-3-52058, a discharging process does not need to be performed before a charging process, and a small-sized image forming apparatus can be achieved. However, the charging device that is disclosed in JP-B-3-52058 has disadvantages in that a size of an alternating current voltage source is increased, and a vibration sound is generated at a nip portion due to an alternating current electric field.

According to the charging methods that is disclosed in each of JP-B-41-21432, JP-A-64-35459, JP-A-1-35460, JP-A-4-21875, JP-A-4-30186, Japanese Patent Number 3230019, JP-A-6-289688 and JP-A-2005-331846, as a primary charger and a secondary static eliminator, a contact-type charger or a discharging device using needle-shaped electrodes are combined, and the primary charger charges a surface of a photoreceptor such that a voltage at the surface of the photoreceptor is increased to a voltage V1 higher than a predetermined voltage V0 and then the secondary static eliminator discharges the voltage at the surface of the photoreceptor such that the voltage at the surface of the photoreceptor becomes the predetermined voltage V0. In an image forming apparatus using the charging device that has the above-described structure, an electrostatic latent image is formed on a photoreceptor charged with the predetermined voltage V0 by an exposure device, a visible image is formed on the electrostatic latent image by a developing device using a toner. Then, a transfer device transfers the visible image on the photoreceptor to paper serving as a transferred material, or an intermediate transfer medium provided between the paper and the photoreceptor. Here, when the visible image formed on the electrostatic latent image is transferred to the intermediate transfer medium, the visible image on the electrostatic latent image is transferred from the intermediate transfer medium to the paper.

Then, the toner image that is transferred to the paper in the above-described method is transported to a fixing device so as to be fixed on the paper. However, at this time, there is a toner that is not transferred to the paper through a transfer operation and remains on the photoreceptor. The reason whey the toner remains on the photoreceptor is because the toner is charged with a polarity opposite to a predetermined polarity due to discharge at the time of the transfer operation. Then, the toner that remains on the photoreceptor is removed from the photoreceptor by a cleaning blade.

However, small-diameter components externally added to the residual toner, such as, for example, silica, are not completely removed from the photoreceptor by the cleaning blade, and pass through the cleaning blade and reach the charging device. In the charging device having the above-described structure, if a brush-shaped charger is used as a primary charger, when the charging device is a contact-type charging device, Paschen discharge is generated in a minute gap and the surface of the photoreceptor is charged. However, at this time, if small-diameter residual materials remain on the photoreceptor, strong discharge is generated due to local electric field concentration on the basis of the small-diameter residual materials, which causes image irregularities. In particular, according to the phenomenon of the electric field being concentrated on the basis of the small-diameter residual materials, when the humidity is low, the strong discharge may be easily generated, in particular, in a roller-shaped charger having a smooth surface.

SUMMARY OF THE INVENTION

According to one embodiment of the invention, there is provided an image forming apparatus in which abnormal discharge can be reduced from being generated in a secondary static eliminator corresponding to a main portion of charging control, a voltage at a surface of a photoreceptor can be stabilized, and image irregularities can be prevented, in a charging device having a primary charger and the secondary static eliminator.

In order to achieve the above-mentioned object, an image forming apparatus according to an aspect of the invention includes a photoreceptor, a charging unit, an exposure unit, a developing unit, a transfer unit, a fixing unit, an environment detecting unit and a control unit. The charging unit includes a charger and a static eliminator. The charger contacts with a surface of the photoreceptor and charges the surface to a first voltage. The static eliminator contacts with the surface and discharges the surface to a second voltage. The exposure unit exposes the surface. The developing unit supplies a toner to the surface so as to form a visible toner image on the surface. The transfer unit transfers the visible toner image formed on the surface to a recording medium. The fixing unit fixes the visible toner image on the recording medium. The environment detecting unit detects an environmental data. The control unit controls the first voltage based on the environmental data.

BRIEF DESCRIPTION OF THE DRAWINGS

Embodiments of the present invention will be described in detail based on the following figures, wherein.

DETAILED DESCRIPTION OF THE INVENTION

The preferred embodiments of the invention will be described in detail with reference to the accompanying drawings.

Embodiment 1

Figure 1:
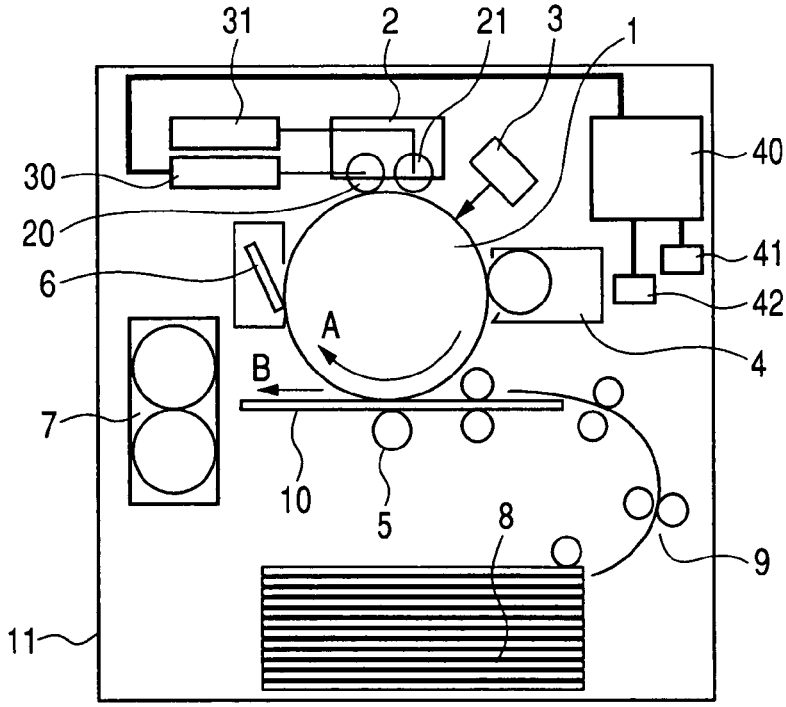
FIG. 1 is a diagram illustrating a schematic structure of an image forming apparatus according to an embodiment of the invention.

FIG. 1 is a diagram illustrating a schematic structure of an image forming apparatus according to a first embodiment. A charging device 2, an exposure device 3, a developing device 4, a transfer device 5, and a cleaning device 6 are disposed along in a direction in which a photoreceptor 1 rotates (a direction shown by an arrow A in FIG. 1). In this embodiment, an erasing device (not shown) is disposed between the transfer device 5 and the cleaning device 6. The erasing device initializes a voltage at a surface of the photoreceptor 1 in front of the charging device 2 to about a zero voltage.

Further, the charging device 2 includes a primary charger 20 and a secondary static eliminator 21. Each of the primary charger 20 and the secondary static eliminator 21 is disposed on upstream and downstream sides of the direction in which the photoreceptor 1 rotates respectively and contacts with the photoreceptor 1.

An overview of the charging of voltage on the photoreceptor will now be described with the exemplary values of voltages for this embodiment.

In this embodiment, threshold voltage values Vth1 and Vth2 are defined as follows. When an absolute voltage value of the primary charger 20 becomes larger than the Vth1, the charge of the voltage on the photoreceptor 1 is started. And, when an absolute voltage difference value between the secondary static eliminator 21 and the photoreceptor 1 becomes larger than the Vth2, the discharge of the voltage on the photoreceptor 1 is started.

When an image is formed, a voltage (−1050 V) having an absolute value larger than the Vth1 (450 V) is applied to the primary charger 20 from a power supply 30. At this time, the voltage (−1050 V) that is applied to the primary charger 20 is adjusted to charge the photoreceptor 1 with a voltage V1 (−550 V).

Further, a voltage V2 (150 V) is applied to the secondary static eliminator 21 from a power supply 31. The V2 (150 V) is adjusted to satisfy the relation that absolute value of a voltage deference (−700 V) between the V1 (−550 V) and the V2 (150 V) is larger than the Vth2 (550 V). As a result, after the voltage is applied to the charging device 2, a voltage charged on the surface of the photoreceptor 1 is uniformed to a predetermined voltage value V0 (−400 V).

Then, the exposure device 3 exposes the surface of the photoreceptor 1, and an electrostatic latent image is formed on the photoreceptor 1. Then, the developing device 4 supplies a toner to the electrostatic latent image of the photoreceptor 1 so as to form a visible image. Further, the transfer device 5 transfers the visible image of the photoreceptor 1 to paper 10 transported in a direction shown by an arrow B along a path 9 by a paper hopper 8. The toner image that is transferred to the paper 10 is transported to the fixing device 7 so as to be fixed on the paper 10. At this time, there is a toner that is not transferred to the paper 10 through a transfer operation and remains on the photoreceptor 1. The toner that remains on the photoreceptor 1 is removed from the photoreceptor 1 by the cleaning device 6. However, small-diameter particle components that are externally added to the toner are not completely removed from the photoreceptor 1 by the cleaning device 6, and thus reach the charging device 2. In this case, residual materials having positive and negative charging polarities exist in residual materials on the surface of the photoreceptor 1, and the residual materials that have one polarity of the positive and negative polarities (in this case, residual materials having a positive polarity) are captured by the primary charger 20.

In this embodiment, as a contact charging type, the primary charger 20 that uses a brush having a relatively strong resistance against contamination is adopted. The primary charger 20 rotates in a direction opposite to the direction in which the photoreceptor 1 rotates. In this case, it is possible to reduce a phenomenon of the residual materials easily permeating into gaps between bristles of the brush and the surface of the primary charger 20 being covered with the residual materials.

In this embodiment, the secondary static eliminator 21 uses a rubber-roller-type contact static eliminator, which has smaller surface unevenness than the brush. Therefore, the voltage at the surface of the photoreceptor 1 is uniformed. The secondary static eliminator 21 is constructed to rotate in accordance with the rotation of the photoreceptor 1. Here, a problem is caused by the residual materials that have the other polarity (in this case, residual materials having a negative polarity) remaining on the photoreceptor 1 without being captured by the primary charger 20. The secondary static eliminator 21 according to this embodiment is constructed such that it performs a discharging operation by using stabilized Paschen discharge in a minute gap that is formed between a smooth surface of the photoreceptor 1 and a smooth surface of the rubber roller used in the secondary static eliminator 21. However, if the small-diameter residual materials remain on the surface of the photoreceptor 1, the residual materials become minute protrusions, and thus strong discharge becomes easily occur due to local electric field concentration on the basis of the minute protrusions. As a result, there may be generated a portion where the voltage at the surface of the photoreceptor 1 is lower than the regular voltage. An undesired toner may be developed to the portion where the voltage becomes lowered than the regular voltage in a next developing process, which causes irregularities of an image.

Further, it is generally known that the strong discharge may easily occur in a low humidity circumference. In the image forming apparatus 11 that is used in this embodiment, the following conditions are set as usable environment conditions. That is, a temperature range of 10 to 32° C. and a humidity range of 10 to 80% RH are set such that dew condensation is not generated.

Figure 2:
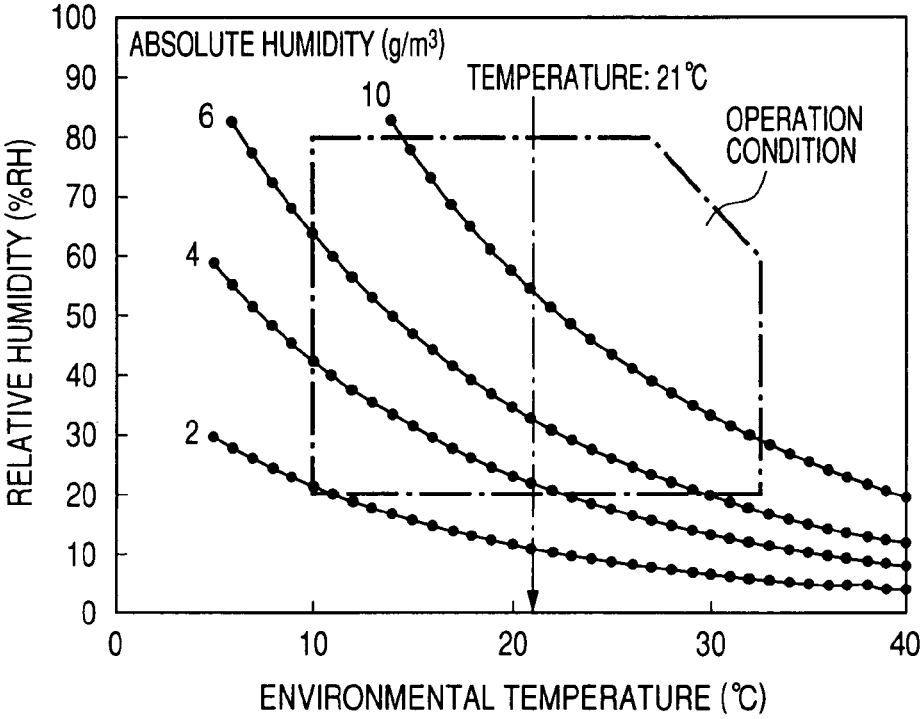
FIG. 2 is a diagram illustrating an environmental range in which an image forming apparatus can be used.

FIG. 2 is a diagram illustrating a usable environment range (in FIG. 2, portion defined by a one-dot chain line and described as operation conditions) of the image forming apparatus 11, and shows curved lines of absolute humidity in the environment. Table 1 shows a result that is obtained by investigating occurrence situations of image irregularities in the usable environment range by using the image forming apparatus 11 according to the embodiment.

TABLE 1

| Environmental Temperature | Absolute Humidity | Voltage (−V) applied to primary charger | | | |
|---|---|---|---|---|---|
| (° C.) | (g/m³) | 1050 | 1100 | 1150 | 1200 |
| 11 | 2 | X | X | Δ | ○ |
| | 3 | X | Δ | ○ | ○ |
| | 4 | Δ | ○ | ○ | ○ |
| | 5 | ○ | ○ | ○ | ○ |
| | 6 | ○ | ○ | ○ | ○ |
| 16 | 2 | X | X | Δ | ○ |
| | 3 | X | Δ | ○ | ○ |
| | 4 | Δ | ○ | ○ | ○ |
| | 5 | ○ | ○ | ○ | ○ |
| | 6 | ○ | ○ | ○ | ○ |
| 21 | 4 | Δ | ○ | ○ | ○ |
| | 5 | ○ | ○ | ○ | ○ |
| | 6 | ○ | ○ | ○ | ○ |
| 25 | 4 | Δ | ○ | ○ | ○ |
| | 6 | ○ | ○ | ○ | ○ |
| | 10 | ○ | ○ | ○ | ○ |
| | 15 | ○ | ○ | ○ | ○ |
| 30 | 8 | ○ | ○ | ○ | ○ |
| | 10 | ○ | ○ | ○ | ○ |
| | 15 | ○ | ○ | ○ | ○ |

○: Image irregularities do not occur.
Δ: Image irregularities do occur to a level which can be allowed.
X: Image irregularities occur In Table 1, reference character ○ indicates that image irregularities do not occur, reference character Δ indicates that image irregularities do occur but occur by a level that can be allowed, and reference character X indicates that image irregularities occur by a level that cannot be allowed. In Table 1, in regards to a voltage (in this case, −1050 V) applied to the primary charger 20, when the absolute humidity is 4 g/m³ or less at each environmental temperature, image irregularities occur. Meanwhile, it could be understood that if the voltage applied to the primary charger 20 is increased, the image irregularities are suppressed from occurring. Further, it could be understood that when the applied voltage is increased (numerically, −1150 V) by about 100 V in an absolute value, even though a minimum absolute humidity that can be considered in the usable environment range is 2 g/m³, an occurrence level of image irregularities can be suppressed to an allowable level, and the image irregularities do not occur when the applied voltage is 1200 V.

The reason is as follows. Generally, since the rubber roller used for the secondary static eliminator 21 has a predetermined a resistance value, it takes a predetermined time to move charges to a surface of the rubber roller. Accordingly, in discharge, such as strong discharge, in which a large amount of charges instantly move, when an amount of charges accumulated on the surface of the rubber roller is small, it is not possible to maintain the strong discharge. When the voltage applied to the primary charger 20 is increased, an absolute value of a voltage at the surface of the photoreceptor 1 propagating to the secondary static eliminator 21 is increased, and an amount of charges discharged by the secondary static eliminator 21 is also increased. In this case, similar to the case of when the strong discharge is made, the charges accumulated on the surface of the roller are discharged. That is, if the voltage applied to the primary charger 20 is increased, the following effects can be obtained. A ratio by which the charges accumulated on the surface of the roller are used by the secondary static eliminator 21 during the regular discharging operation is increased. As a result, even in the situation where strong discharge easily occurs, it is possible to make the charges used at the time of the strong discharge not exist, which prevents the strong discharge from occurring.

Figure 7:
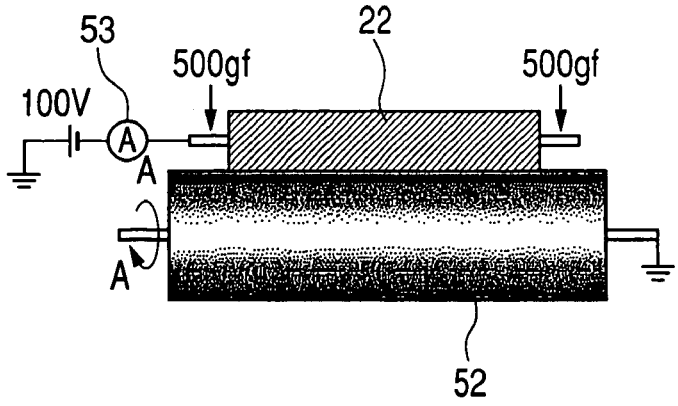
FIG. 7 is a diagram schematically illustrating a method of measuring a roller resistance.

In this case, a resistance value of the rubber roller of the secondary static eliminator 21 used in this embodiment is selectively used in a range of 0.1 to 0.3 MΩ. As shown in FIG. 7, the resistance value uses a value that is obtained by applying a load of about 500 gf to both ends of a shaft of the roller 22, pressing a cylindrical metal electrode 52, applying a direct current voltage of 100 V to a shaft portion of the charging roller 2 while the metal electrode 52 rotates at a predetermined peripheral velocity, and converting a measured value of a current flowing through an ammeter 53 after a time passes by 30 seconds. At this time, the resistance value is measured under conditions where a diameter of the metal electrode 52 is set to 0.03 m, a peripheral velocity is set to 0.2 m/s, a nip area of the roller 22 and the metal electrode 52 is set to $1.6\times10^{-4}$ m², and the distance between the shaft of the roller 22 and the surface of the metal electrode 52 is set to $2\times10^{-3}$ M.

As described above, according to a bad effect that occurs when the voltage applied to the primary charger 20 is increased, when the withstand pressure of the photoreceptor 1 is lowered under conditions of the high temperature and humidity, the voltage may damage the photoreceptor 1. Accordingly, in this embodiment, the temperature sensor 41 and the humidity sensor 42 shown in FIG. 1 are provided as environment detecting units, and the voltage applied to the primary charger 20 is changed according to the environment. Specifically, the temperature and the humidity that are detected by the temperature sensor 41 and the humidity sensor 42 respectively are received by the control unit 40 that calculates the absolute humidity in the environment.

At this time, when the absolute humidity exceeds 4 g/m³, an absolute value of the voltage that is applied to the primary charger 20 from the power supply 30 is controlled such that the regular voltage of −1050 V is applied. Meanwhile, when the absolute humidity is 4 g/m³ or less, an absolute value of the voltage that is applied to the primary charger 20 from the power supply 30 is increased to be larger in absolute value by 100 V or more as compared with an absolute value of the regular voltage of −1050 V, and a voltage of −1200 V is applied.

As a result, it is possible to provide an image forming apparatus in which strong discharge can be avoided in the low humidity condition and image irregularities can be prevented, without damaging the photoreceptor 1.

In this embodiment, a drum-shaped base of the photoreceptor 1 is connected to a ground so as to have a zero voltage. However, the voltage may be applied to the base of the photoreceptor 1. In this case, the voltage that is applied to the charging device 2 becomes a value that is obtained by overlapping the voltage applied to the base of the photoreceptor 1.

Second Embodiment

This embodiment relates to an image forming apparatus 11 that does not use the humidity sensor 42, and the basic operation is the same as that of the first embodiment.

Figure 3:
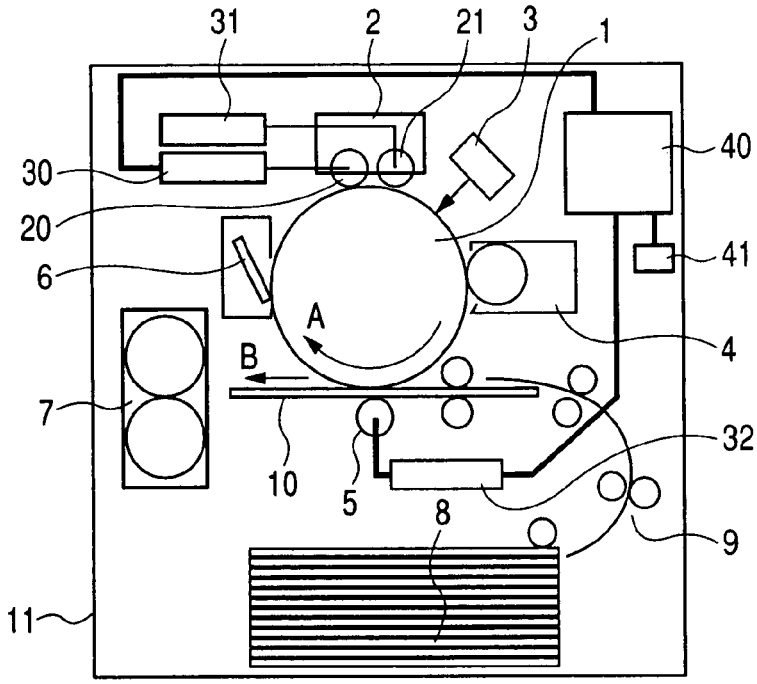
FIG. 3 is a diagram illustrating a schematic structure of another image forming apparatus according to an embodiment of the invention.

In this embodiment, as shown in FIG. 3, only the temperature sensor 41 is used as the environment detecting unit. Since the humidity sensor is not provided, and the humidity environment is detected on the basis of a value of a current flowing through the transfer device 5 that uses a roller transfer method. In a state where paper 10 serving as a recording medium is not interposed between the photoreceptor 1 and the transfer device 5, a predetermined reference voltage is applied to the transfer device 5 by the power supply 32, and a value of a current flowing at the time of the voltage application is detected. The control unit 40 receives the detected current and temperature information detected by the temperature sensor 41 as environment information. A characteristic that a current flowing through the transfer device 5 is increased when the environment temperature is high or the absolute humidity is increased is used in this embodiment. A current (y) that flows through the transfer device 5 used in this embodiment is in accordance with a relation equation $y=52+1.37\times T+1.25\times H$, when it is assumed that the temperature is defined as T (° C.) and the absolute humidity is defined as H ($g/cm^3$). Using this relation equation, by applying the detected current information to (y) and the detected temperature information to (T), the absolute humidity (H) is calculated in the control unit 40.

When the calculated absolute humidity exceeds 4 $g/m^3$, an absolute value of the voltage that is applied to the primary charger 20 from the power supply 30 is controlled such that the regular voltage of −1050 V is applied. Meanwhile, when the absolute humidity is 4 $g/m^3$ or less, an absolute value of the voltage that is applied to the primary charger 20 from the power supply 30 is increased to be larger in absolute value by 100 V or more as compared with an absolute value of the regular voltage of −1050 V, and a voltage of −1200 V is applied.

The current value (y) that is used in this case uses numerical values that are obtained by converting a maximum value of a current flowing through the power supply into 256 and converting a minimum value into 0. Further, the relation equation is applied to the devices that are used in this embodiment. Further, it is needless to say that the relation equation may be changed according to the characteristics of the transfer device 5 and the photoreceptor 1 that are used in the embodiments.

In this embodiment, it is possible to provide an image forming apparatus in which strong discharge can be avoided in the low humidity condition and image irregularities can be prevented without damaging the photoreceptor 1, by using the above-described operation.

This embodiment uses the value of the current flowing through the transfer device 5 that comes into contact with the photoreceptor 1. However, in the case of the structure where the image is transferred from the photoreceptor 1 to the intermediate transfer medium and the image transferred to the intermediate transfer medium is transferred to the paper, it may possible to use a value of a current that flows through the transfer device coming in contact with the intermediate transfer medium.

Third Embodiment

This embodiment exemplifies another control operation of the method using the current flowing through the transfer device 5 illustrated in the second embodiment. In the third embodiment, the basic operation is the same as those of the first and second embodiments.

Figure 4:
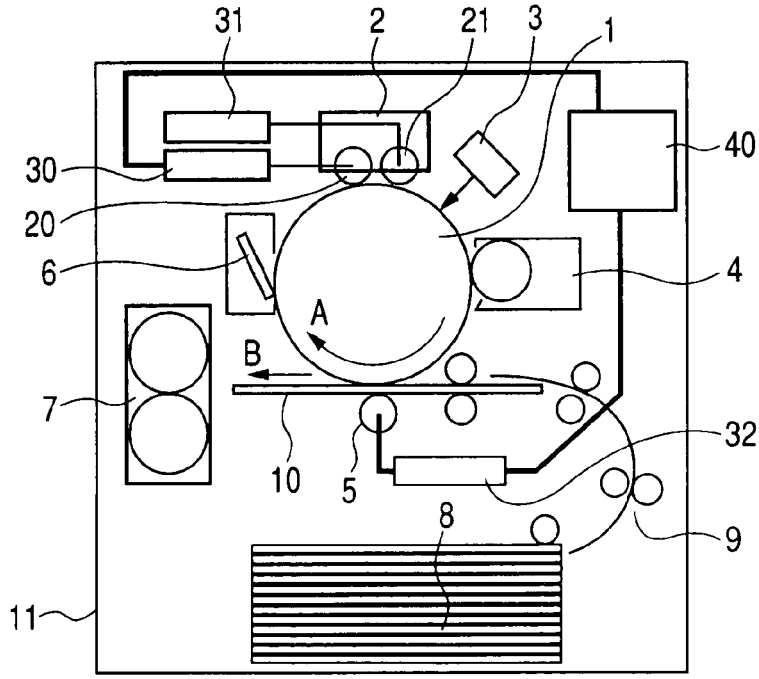
FIG. 4 is a diagram illustrating a schematic structure of still another image forming apparatus according to an embodiment of the invention.

In this embodiment, as shown in FIG. 4, neither the temperature sensor 41 nor the humidity sensor 42 is provided, and the environment is detected based on the current flowing through the transfer device 5 that uses a roller transfer method. Specifically, in a state where the paper 10 is not interposed between the photoreceptor 1 and the transfer device 5, a predetermined reference voltage is applied to the transfer device 5 by the power supply 32, and the value of the current flowing at the time of voltage application is received by the control unit 40. The detected current that is used in this case uses numerical values that are obtained by converting a maximum value of a current flowing through the power supply 32 into 256 and converting a minimum value into 0. The initially determined maximum current I (μA) is divided by 256 (current 0 is set to 0), and the obtained values are shown. In regards to the actually flowing current i (μA), the detected current value becomes i/I *256 (unit does not exist). When the current exceeding the current I, an output value becomes 256.

Figure 5:
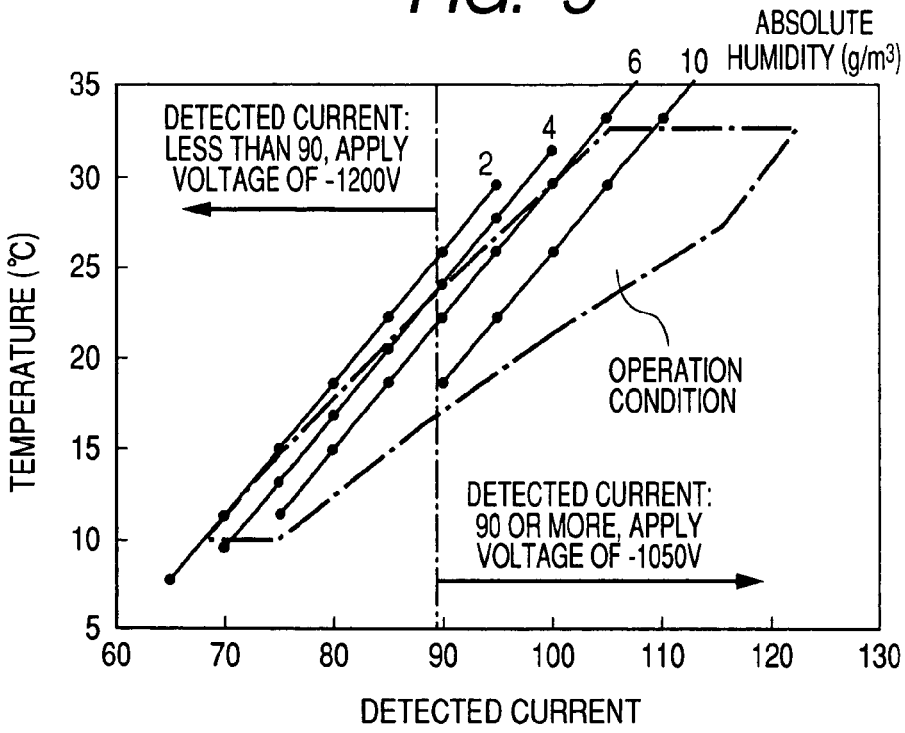
FIG. 5 is a diagram illustrating an environmental range in which an image forming apparatus can be used with a relationship between a current flowing through a transfer device and a temperature.

FIG. 5 is a diagram illustrating a usable environment range (in FIG. 5, portion shown by a one-dot chain line and described as operation conditions) of the image forming apparatus 11 with a relationship between a detected current flowing through the transfer device 5 used in this embodiment and an environmental temperature, and shows curved lines of absolute humidity in the environment. From FIG. 5, in the usable environment range, the absolute humidity can be 4 $g/m^3$ or less only when the detected current value is less than 90. Further, the range of temperature in the usable environment when the detected current is less than 90 is less than 21° C., and does not become the conditions of the high temperature and high humidity. Accordingly, in this embodiment, when the detected current received by the control unit 40 is less than 90, the voltage that is applied to the primary charger 20 from the power supply 30 is increased to be larger in an absolute value by 100 V or more as compared with an absolute value of a regular voltage, and a voltage of −1200 V is applied. Meanwhile, when the detected current received by the control unit 40 exceeds 90 (the absolute humidity exceeds 4 $g/m^3$), an absolute value of the voltage that is applied to the primary charger 20 from the power supply 30 is controlled such that the regular voltage of −1050 V is applied.

As a result, similar to the first embodiment, even in this embodiment, it is possible to provide an image forming apparatus in which strong discharge can be avoided in the low humidity condition and image irregularities can be prevented without damaging the photoreceptor 1, by the above-described operation.

Even in this embodiment, in the case of the structure where the image is transferred from the photoreceptor 1 to the intermediate transfer medium and the image transferred to the intermediate transfer medium is transferred to the paper, it may possible to use a value of a current that flows through the transfer device coming in contact with the intermediate transfer medium.

Fourth Embodiment

This embodiment relates to an image forming apparatus 11 that uses only the temperature sensor 41, and the basic operation is the same as that of the first embodiment.

Figure 6:
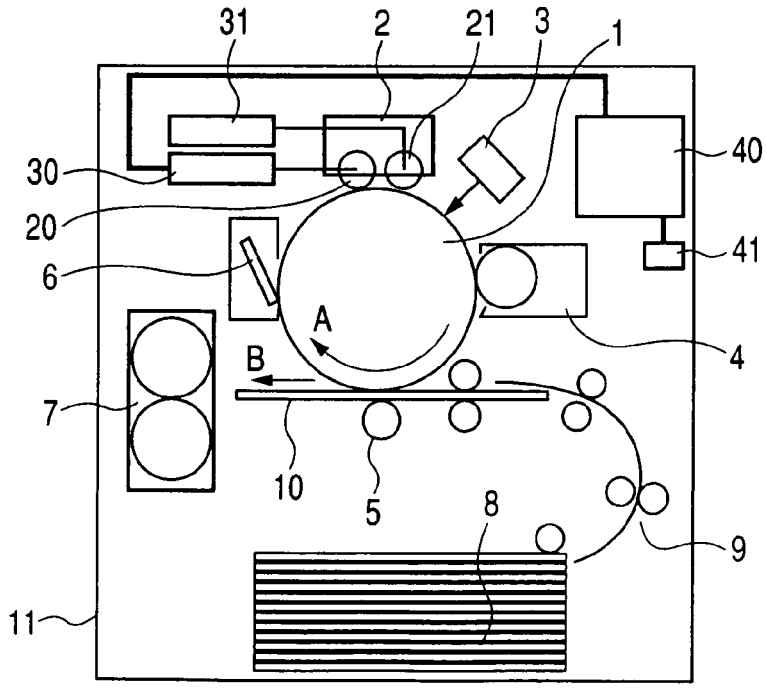
FIG. 6 is a diagram illustrating a schematic structure of still another image forming apparatus according to an embodiment of the invention.

In this embodiment, as shown in FIG. 6, the temperature sensor 41 is only used as the environment detecting unit. The control operation in this case will be described in detail.

As described above, FIG. 2 is a diagram illustrating a usable environment range (in FIG. 2, portion shown by a one-dot chain line and described as operation conditions) of the image forming apparatus 11, and shows curved lines of absolute humidity in the environment. From FIG. 2, in the usable environment range, the absolute humidity can be 4 $g/cm^3$ or less only when the temperature is less than 21° C. Accordingly, in this embodiment, the temperature value detected by the temperature sensor 41 is received by the control unit 40.

At this time, when detected temperature is less than 21° C., the voltage that is applied to the primary charger 20 from the power supply 30 is increased to be larger in an absolute value by 100 V or more as compared with an absolute value of a regular voltage, and a voltage of −1200 V is applied. Meanwhile, when the detected temperature is 21° C. or more, an absolute value of the voltage that is applied to the primary charger 20 from the power supply 30 is controlled such that the regular voltage of −1050 V is applied. As a result, even in this embodiment, it is possible to provide an image forming apparatus in which strong discharge can be avoided in the low humidity condition and image irregularities can be prevented, without damaging the photoreceptor 1.

Figure 8:
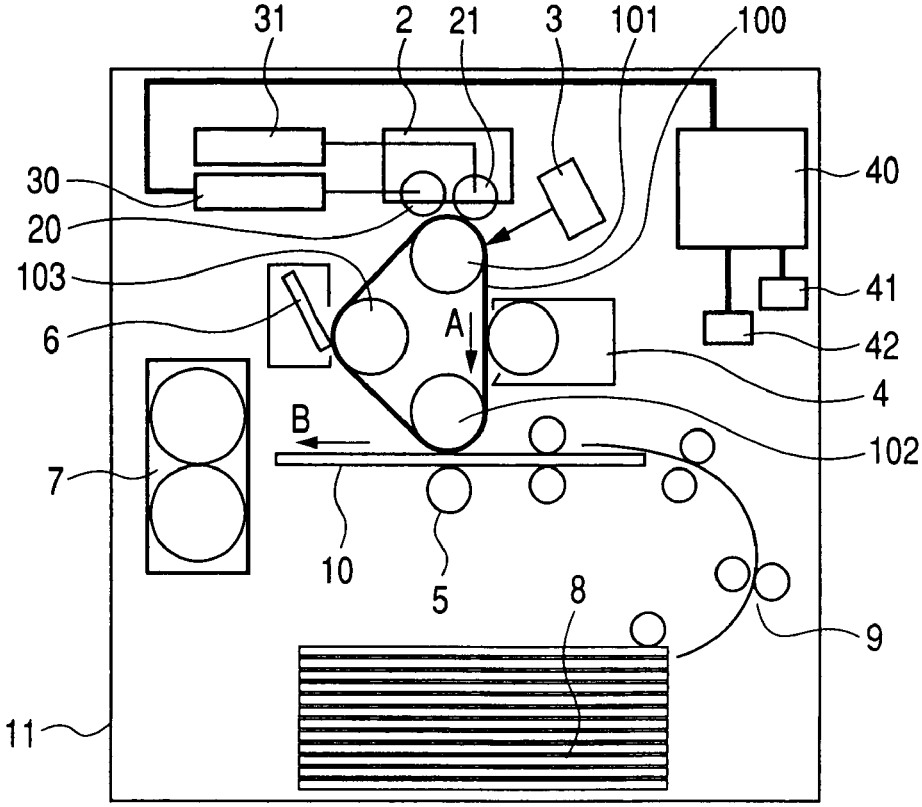
FIG. 8 is a diagram illustrating a schematic structure of still another image forming apparatus according to another embodiment of the invention.

FIG. 8 is a diagram illustrating a schematic structure of an image forming apparatus according to another embodiment. The basic structure of the image forming apparatus according to another embodiment is the same as that of the image forming apparatus according to the first embodiment shown in FIG. 1, except that a photoreceptor belt 100 is used as the photoreceptor. That is, a charging device 2, an exposure device 3, a developing device 4, a transfer device 5, and a cleaning device 6 are sequentially disposed in a direction in which the photoreceptor belt 100 rotates (shown by an arrow A in FIG. 8). In this embodiment, the photoreceptor belt 100 is wound on a driving roller 101 that rotates the photoreceptor belt 100 in a predetermined direction, and two driven rollers 102 and 103. Further, in this embodiment, although not shown, an erasing device is disposed between the transfer device and the cleaning device 6, and a voltage at a surface of the photoreceptor belt 100 in front of the charging device 2 is initialized to a zero voltage.

Further, in the charging device 2, a primary charger 20 and a secondary static eliminator 21 are respectively disposed on upstream and downstream sides of the rotation direction of the photoreceptor belt 100, such that they come into contact with the photoreceptor belt 100.

In this embodiment, since the same evaluation result as the above-described embodiments is obtained, the description thereof will be omitted.

In this embodiment, it is possible to achieve an excellent image forming apparatus which detects the environment in which the image forming apparatus is disposed, selects an optimal state of the primary charger in which the abnormal discharge in the second static eliminator does not occur, and stabilizes the voltage state at the surface of the photoreceptor belt after the voltage is applied to the charging device so as to prevent the image irregularities from occurring.

Further, the image forming apparatus can be applied to a case where a charging operation needs to be stably performed on the charged devices and abnormal discharging of the charging device needs to be prevented from occurring in the various environments.

According to the image forming apparatus according to an aspect of the invention that uses the charging device including the charger and the static eliminator, it is possible to achieve an image forming apparatus in which even in the extremely low humidity environment, abnormal discharge can be reduced from being generated in the secondary static eliminator, and image irregularities can be prevented from occurring.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiments of the invention without departing substantially from the spirit and principles of the invention.

For example, the voltage applied to the primary charger 20 from the power supply 30 may be controlled by the control unit 40 or by the power supply 30 itself.

In addition, the value of the absolute humidity may be calculated from the temperature, the humidity or the current flowing through the transfer device 5, or directly detected by an absolute humidity sensor.

What is claimed is:

1. An image forming apparatus comprising:

a photoreceptor;

a charging unit that includes:

a charger that contacts with a surface of the photoreceptor and charges the surface to a first voltage; and a static eliminator that contacts with the surface and discharges the surface from the first voltage to a second voltage;

an exposure unit that exposes the surface which is charged to substantially the second voltage;

a developing unit that supplies a toner to the surface so as to form a visible toner image on the surface;

a transfer unit that transfers the visible toner image formed on the surface to a recording medium;

a fixing unit that fixes the visible toner image on the recording medium;

an environment detecting unit that detects an environmental data; and a control unit that controls the first voltage based on the environmental data, wherein the environmental data includes a temperature value detected by the environment detecting unit, and wherein the control unit controls the first voltage to be greater in absolute value by 100 V or more when the temperature value is 21° C. or less.

2. The image forming apparatus according to claim 1, wherein:

the charger includes a brush-shaped charger, and the static eliminator includes a roller-shaped static eliminator.

3. The image forming apparatus according to claim 1, wherein the environment detecting unit includes a temperature sensor and a humidity sensor.

4. The image forming apparatus according to claim 1, wherein:

the environment detecting unit includes a temperature sensor and a current sensor, and the environmental data includes a temperature value detected by the temperature sensor and a current value of a current flowing through the transfer unit detected by the current sensor.

5. The image forming apparatus according to claims 1, wherein:

the environment detecting unit includes an absolute humidity sensor, and the environmental data includes an absolute humidity value detected by the absolute humidity sensor.

6. The image forming apparatus according to claim 5, wherein the control unit controls the first voltage to be larger when the absolute humidity value is a predetermined absolute humidity limit value or less.

7. The image forming apparatus according to claim 5, wherein the control unit controls the first voltage to be greater in absolute value by 100 V or more when the absolute humidity value is 4 $g/m^3$ or less.

8. The image forming apparatus according to claim 1, wherein:

the environment detecting unit includes a temperature sensor, and the environmental data includes a temperature value detected by the temperature sensor.

9. The image forming apparatus according to claim 8, wherein the control unit controls the first voltage to be greater when the temperature value is a predetermined temperature limit value or less.

10. The image forming apparatus according to claim 2, wherein the brush-shaped charger rotates in a direction opposite to a direction in which the photoreceptor rotates.

11. An image forming apparatus comprising:

a photoreceptor;

a charging unit that includes:

a charger which charges a surface of the photoreceptor to a first voltage; and a static eliminator that discharges the surface to a second voltage;

an exposure unit that exposes the surface which is charged to the second voltage;

a developing unit that supplies a toner to the surface so as to form a visible toner image on the surface;

a transfer unit that transfers the visible toner image formed on the surface to a recording medium;

an environment detecting unit that detects an environmental data; and a control unit that controls the first voltage based on the environmental data, wherein the environmental data includes an absolute humidity value detected by the environment detecting unit, and wherein the control unit controls the first voltage to be greater in absolute value by 100V or more when the absolute humidity value is 4 $g/m^3$ or less.

12. The image forming apparatus according to claim 11, wherein a gap is formed between the static eliminator and the surface.

13. The image forming apparatus according to claim 1, wherein the environment detecting unit includes a current sensor, and a humidity value is determined based on a value of a current flowing through the transfer unit detected by the current sensor.

14. The image forming apparatus according to claim 1, wherein, when the environment detecting unit detects a humidity less than a predetermined value, the first voltage is increased by the control unit.

15. The image forming apparatus according to claim 1, further comprising a cleaning device disposed along a periphery of the photoreceptor between the transfer unit and the charging unit.

16. A method for charging a photoreceptor comprising:

charging a surface of the photoreceptor to a first voltage with a charger that contacts the surface of the photoreceptor;

discharging the surface to a second voltage with a static eliminator;

exposing the surface which is charged to the second voltage;

detecting an environmental data with an environmental detecting unit; and controlling the first voltage with a control unit based on the detected environmental data, wherein the charger charges the first voltage to be greater in absolute value by 100 V or more when the temperature value is 21° C. or less.

17. The image forming apparatus according to claim 1, wherein the charging unit is upstreamly positioned with respect to the exposure unit in a rotating direction of the photoreceptor, and wherein, in the charging unit, the charger is upstreamly positioned with respect to the static eliminator in the rotating direction of the photoreceptor.

18. The image forming apparatus according to claim 17, wherein the charging unit is positioned directly adjacent to the exposure unit in the rotating direction, and wherein the charger is positioned directly adjacent to the static eliminator in the rotating direction.

19. The image forming apparatus according to claim 1, wherein the environment detecting unit includes a current sensor, and wherein the environmental data includes a current value of a current flowing through the transfer unit detected by the current sensor.

20. The image forming apparatus according to claim 11, wherein the environment detecting unit includes a current sensor, and wherein the environmental data includes a current value of a current flowing through the transfer unit detected by the current sensor.

21. The image forming apparatus according to claim 1, wherein the environment detecting unit determines the environmental data according to the equation:

$$y=52+1.37*T+1.25*H,$$

where y comprises a current flowing through the transfer unit, T comprises a temperature (° C.), and H comprises an absolute humidity ($Hg/m^3$).

* * * * *